US007503464B2

(12) United States Patent
McCain

(10) Patent No.: US 7,503,464 B2
(45) Date of Patent: Mar. 17, 2009

(54) COMBINATION A FOOD PLATE HAVING DETACHABLE, RE-ATTACHABLE EATING UTENSILS

(76) Inventor: Paul R. McCain, 14355 Sundance Dr., Reno, NV (US) 89511

( * ) Notice: Subject to any disclaimer, the term of this patent is extended or adjusted under 35 U.S.C. 154(b) by 627 days.

(21) Appl. No.: 11/098,834

(22) Filed: Apr. 5, 2005

(65) Prior Publication Data

US 2006/0218795 A1 Oct. 5, 2006

(51) Int. Cl.
*A47G 19/06* (2006.01)
*A45C 11/20* (2006.01)

(52) U.S. Cl. ..... 220/574.1; 206/541

(58) Field of Classification Search ..... 206/223, 206/542, 557, 564, 565, 541; 220/574, 574.1, 220/735; 248/37.3; 229/904
See application file for complete search history.

(56) References Cited

U.S. PATENT DOCUMENTS 3,704,779 A * 12/1972 Nigg ..... 220/556
4,863,033 A * 9/1989 Buj ..... 206/541
5,222,622 A * 6/1993 Laske, Jr. ..... 220/574.1
5,785,238 A * 7/1998 Tai ..... 229/103
5,938,066 A * 8/1999 DeMars ..... 220/574.1
6,412,653 B1 * 7/2002 Waterhouse ..... 220/556

* cited by examiner

*Primary Examiner*—Bryon P Gehman
*Assistant Examiner*—Blaine G Neway

(57) ABSTRACT

An integrally formed food plate such as used for picnics or the like and includes integrally attached utensils therewith in combination. The utensils when manually manipulated are easily detached for use. However, the utensils each further include novel pinholes that allow for re-attachment onto the food plate when not in use. Furthermore, the utensils may be standard such as in the form of a spoon, a knife and a fork, or as an alternative the utensils may be in the form of chopsticks. Another option is to include a toothpick that is integrally formed with the food plate yet is also detachable as well.

11 Claims, 2 Drawing Sheets

COMBINATION A FOOD PLATE HAVING DETACHABLE, RE-ATTACHABLE EATING UTENSILS

FIELD OF THE INVENTION

This invention relates in general to food containers or the like but more particularly pertains to a food plate having novel detachable/re-attachable means for detachably connecting and re-attaching a utensil to an exterior edge thereof. The food plate and utensils are integrally formed together as one complete unit by plastic mold injection. Furthermore, the utensils may be typical such as a spoon, a knife, or a fork, but other options include a pair of chopsticks and/or a detachable toothpick.

DESCRIPTION OF THE PRIOR ART

Conventional apparatuses exist for attaching eating utensils to plates, panels and the like. For example, U.S. Pat. No. 3,565,245 teaches a combination food container and utensil in which the utensil is outlined by slits in the utensil material. The eating utensil is integrally constructed with sheet material of a panel by a pair of opposed, relatively short, frangible tabs. The tabs provide a bridge that interconnects the utensil with the panel. The utensil is accessed by applying pressure to the projecting ends of the utensil to cause the tabs to break. It is apparent that once the utensil is detached with respect to the panel and the tabs are broken, the utensil cannot be re-attached to the panel.

U.S. Pat. No. 4,863,033 teaches a set of eating utensils for children. The eating utensils are attached to a plate. A toy figure is attached to the plate. The plate has pegs for mounting a spoon, a fork or knife, each of which have an identical or complementary toy figure removably attached to the handle of the spoon, fork or knife. The handle of the utensil has a hole into which the peg fits so that the utensil can be attached to the plate.

U.S. Pat. Nos. 3,704,779 and 217,632 disclose utensils having breakable bridges or necks for attaching an eating utensil to a main tray part. The utensils are supported by projections that have narrow plastic bridges that can be easily broken by a user. The plastic bridges are relatively small in cross section so as to permit easy fracturing by the user. The utensils taught by such patents cannot be re-attached to the plate.

U.S. Pat. No. 3,029,969 discloses a table setting device wherein utensils are positioned within compartments separated by dividing walls. U.S. Pat. No. 3,939,976 also teaches a table setting device in which multiple table place settings are attached or mounted to a roll of flexible material. Each section is separated from each other by perforations, for removal of one or more place settings.

U.S. Pat. No. 2,652,702 discloses a combination picnic tray and platter wherein the tray is divided into various compartments. Each corresponding compartment accepts a drinking container, a knife, a fork, a spoon or a napkin.

It is apparent from such prior art patents that there exists a need for an apparatus in which a utensil, such as an eating utensil, can be detachably connected or attached to a container in a re-usable fashion.

SUMMARY OF THE INVENTION

It is therefore one object of this invention to provide a food plate having at least one eating utensil that is detachably connected and easily re-attached.

It is another object of the present invention to provide in combination a food plate having the noted utensils therewith that may be easily formed as one integrally formed unit such as by plastic mold injection.

It is still another object of this invention to provide a food plate and utensils in combination that is aesthetically pleasing to the eye or end user.

Yet a further object of the present invention is to provide a food plate and utensils in combination that may further include an integrally formed and removably attached toothpick.

Still a further object of the present invention is to provide a food plate and utensils in combination that when packaged or sold to the consumer allows for multiple food plates and utensils to be easily stacked one on top of the other.

Also, another object of the present invention is to provide a food plate and utensils in combination that is compartmented for various uses. For example, the compartments may be used for containment of large food items such as a sandwich, smaller compartments for smaller food products such as mashed potatoes, vegetables or a cracker, or other items such as a napkin or wet packaged Handi-Wipe™ or the like. Or still further and most advantageous is an upraised circular receptacle that is functional as a soup bowl, or serves to support a collapsible cup, a paper cup or an aluminum can or the like.

Still another object of the present invention is to provide a food plate and utensils in combination that can be manufactured in multiple shapes depending on engineering choice. For example, the food plate may be in the form of an octagon, circular, triangular, etc.

Other objects and advantages will become apparent when taken into consideration with the following drawings and specification.

DETAILED DESCRIPTION OF THE DRAWINGS

Referring now in detail to the drawings wherein like characters refer to like elements throughout the various views. The present invention is substantially in combination a food plate (10) having at least one detachable re-attachable eating utensil integrally formed therewith. It is to be understood the food plate (10) provides novel detachment re-attachment means heretofore not taught. It is to be further understood the present invention is manufactured or produced as one complete integrally formed unit such as by plastic mold injection or the like. Furthermore, various configurations and different types of utensils may be incorporated depending on engineering choice and/or end user preferences. The novel detachment re-attachment means at taught herein may be used for one utensil or multiples thereof. Thus, the following first description represents use of the detachment re-attachment means for one utensil, respectively.

Figure 1:
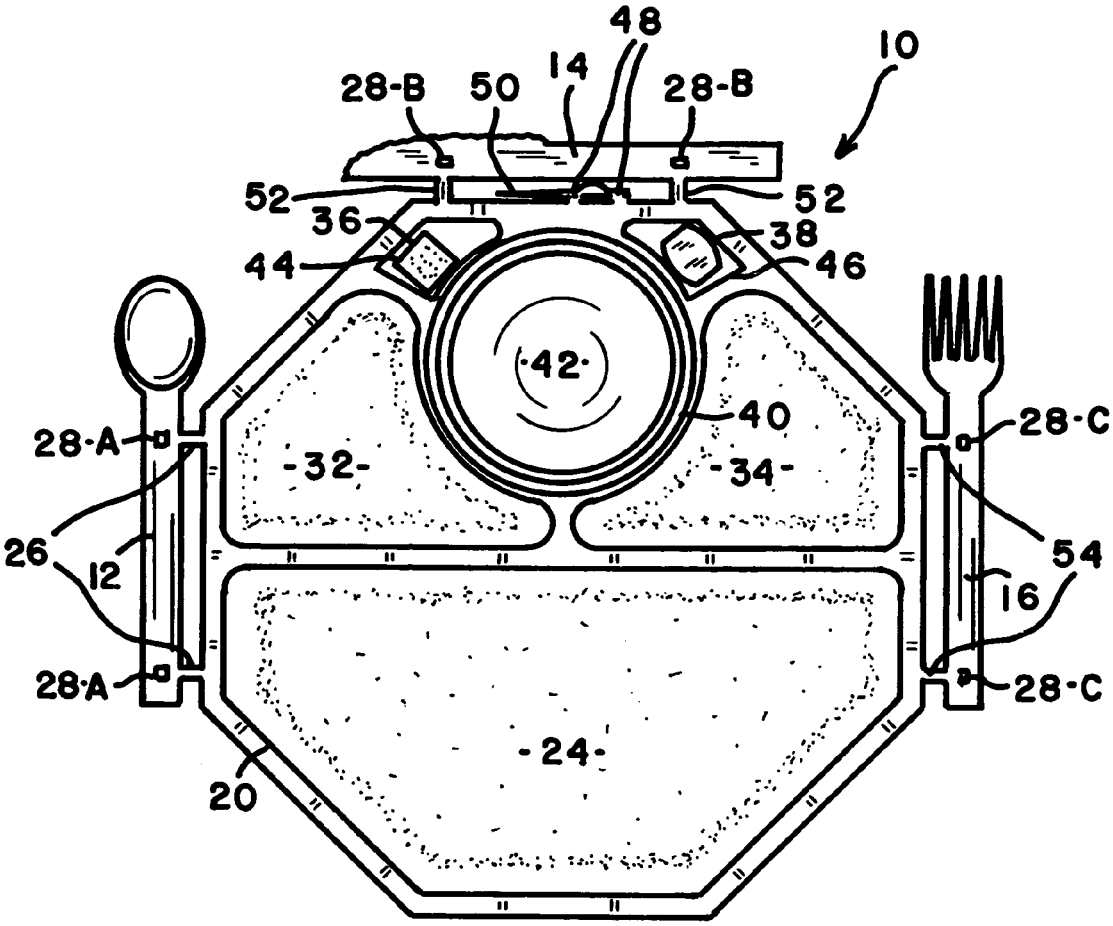
FIG. 1 is substantially an overview of the preferred embodiment for the present invention including typical utensils such as a spoon, a knife, a fork and also a toothpick.
Figure 2:
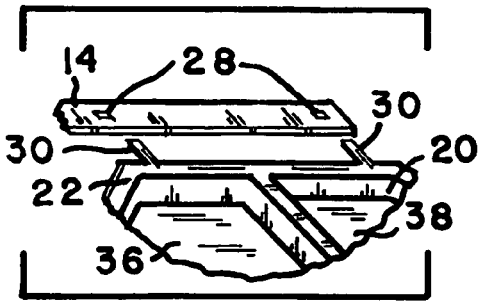
FIG. 2 is substantially a perspective view partially depicting one of the utensils when in a detached position.
Figure 3:
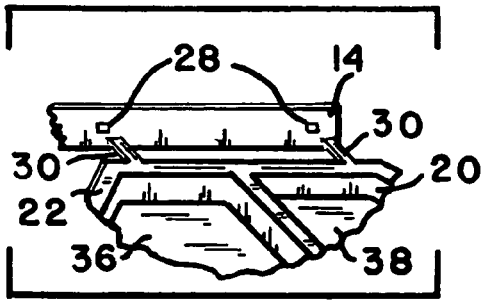
FIG. 3 is substantially a perspective view partially depicting the utensil of FIG. 2 when in a re-attached position.

Referring now to FIGS. 1-3 wherein the food plate (10) is depicted having a detachable re-attachable eating utensil of engineering choice. The eating utensil may be either a spoon (12), a knife (14), a fork (16) or the like. Food plate (10) is substantially formed from a base member (20) having an upraised exterior edge (22). As can be seen within FIGS. 1 & 4 the base member (20) with upraised exterior edge (22) form at least a first food compartment (24). Upraised exterior edge (22) having a first pair of outwardly extending protrusions (26) that are integrally formed with at least one detachable re-attachable eating utensil (12, 14 or 16) having a first pair of pin holes (28) there through that are substantially in alignment with the first pair of outwardly extending protrusions (26) when in the attached position before being detached or broken off as further defined hereafter.

Figure 4:
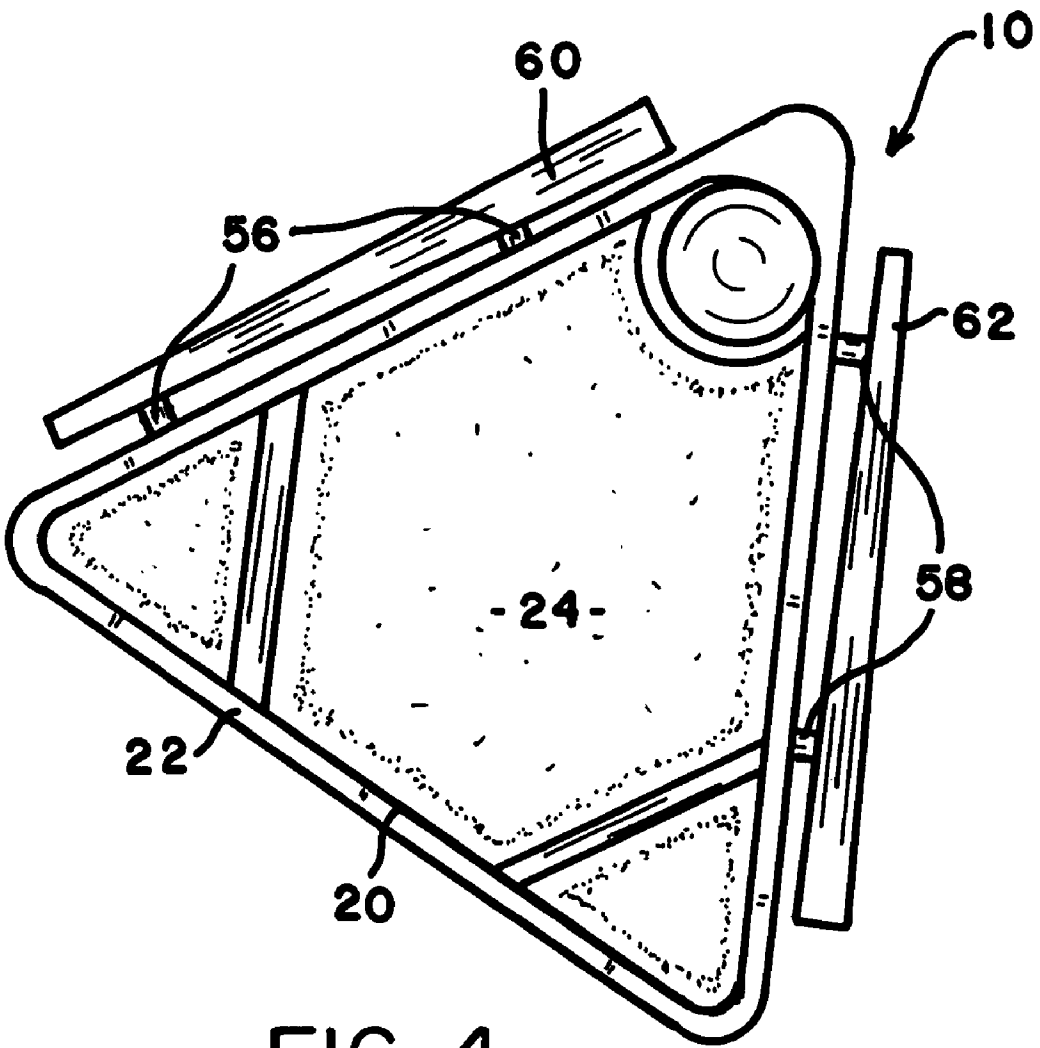
FIG. 4 is substantially an overview of a slightly different embodiment depicting the food plate having a pair of chopsticks therewith.

The detachable re-attachable eating utensil (12, 14 or 16) has an attached position, a detached position, and a re-attached position. Detachable re-attachable eating utensil when in the attached position is integrally attached with the first pair of outwardly extending protrusions (26) as depicted in FIGS. 1 and 4. The detachable re-attachable eating utensil assumes the detached position as depicted in FIG. 2, when the first pair of outwardly extending protrusions (26) are manually manipulated until broken. After being broken protrusions (26) are substantially transformed so as to form a first pair of outwardly extending pins (30) as more clearly defined and depicted in FIG. 2. Detachable re-attachable eating utensil assumes the re-attached position when manually rotated until the first pair of pin holes (28) are aligned with the first pair of outwardly extending pins (30) and manually frictionally engaged into a mating relationship within the first pair of pin holes (28) as clearly depicted in FIG. 3.

As can be seen in FIG. 1, the base member (20) of food plate (10) may be partitioned forming the first food compartment (24) and/or multiple compartments (32, 34, 36, and 38) for containment and use for various food products of user choice. For example, first food compartment (24) may be used for containment of a main course such as a sandwich or the like (not shown). Compartments (32 and 34) may be used for other food products such as mashed potatoes or vegetables, etc. and food compartments (36 and 38) may be used for food items such as a cracker (44) or other specialty items such as a napkin (46) that may simply be folded or pre-packaged for sanitary reasons. The napkin (46) may also be in the form of a pre-packaged wet wipe, such as a Handi-Wipe™ or the like.

However, in the preferred embodiment as depicted in FIG. 1, one of the multiple compartments is formed into an upraised receptacle (40) that is of a shape and size to function as either an integrally formed soup bowl, or if preferred it may also function a suitable support for a drinking cup or other container of user choice such as a pop-can, etc. This upraised receptacle (40) is most novel, and provides unusual results heretofore not taught.

Another novel feature of the present invention is to further provide an additional pair of outwardly extending protrusions (48) that are integrally formed with a toothpick (50). It is to be noted the toothpick may be integrally attached by only one protrusion (48) if so desired but multiples are most efficient. Thus when the additional pair of outwardly extending protrusions (48) are manually manipulated until broken, the toothpick then becomes easily detached for use.

The above description substantially address the attachment, detachment and re-attachment means and is functional for use with one utensil, only one food compartment, or as hereafter defined multiples of each are further included as follows.

Food plate (10) is formed from a base member (20) an upraised exterior edge (22). The base member in combination with upraised exterior edge forming at least a first food compartment (24). Upraised exterior edge having a first pair of outwardly extending protrusions (26), a second pair of outwardly extending protrusions (52) and a third pair of outwardly extending protrusions (54). The noted detachable, re-attachable, eating utensils include a spoon (12), a knife (14) and a fork (16), or the like. As depicted herein, the first pair of outwardly extending protrusions (26) are integrally formed with spoon (12), the second pair of outwardly extending protrusions (52) are integrally formed with knife (14) and the third pair of outwardly extending protrusions (54) are integrally formed with fork (16).

As further depicted in FIG. 1, spoon (12) includes a first pair of pin holes (28-A) there through that are in alignment with the first pair of outwardly extending protrusions (26) when in the attached position before being manually broken. Knife (14) includes a second pair of pin holes (28-B) there through that are in alignment with the second pair of outwardly extending protrusions (52) when in the attached position before being manually broken. Fork (16) includes a third pair of pin holes (28-C) there through that are in alignment with the third pair of outwardly extending protrusions (54) when in the attached position before being manually broken.

As can be seen each utensil, namely spoon (12), knife (14) and fork (16) each have an attached position see FIG. 1, a detached position see FIG. 2 and a re-attached position see FIG. 3. For further clarification, the spoon (12) when in the attached position is integrally formed and attached with the first pair of outwardly extending protrusions (26). The spoon (12) assumes the detached position when the first pair of outwardly extending protrusions (26) are manually manipulated until broken and the first pair of outwardly extending protrusions (26) when manually manipulated until broken form a first pair of outwardly extending pins (30) such as illustrated within FIG. 2. The spoon (12) assumes the re-attached position when spoon (12) is manually rotated until the first pair of pin holes (28-A) are aligned with the first pair of outwardly extending pins (30) and the first pair of outwardly extending pins (30) are frictionally engaged into a mating relationship within the first pair of pin holes (28-A).

The knife (14) when in the attached position is integrally formed and attached with the second pair of outwardly extending protrusions (52). The knife (14) assumes the detached position when the second pair of outwardly extending protrusions (52) are manually manipulated until broken and the second pair of outwardly extending protrusions (52) when manually manipulated until broken form a second pair of outwardly extending pins such as illustrated within FIG. 2. The knife (14) assumes the re-attached position when knife (14) is manually rotated until the second pair of pin holes (28-B) are aligned with the second pair of outwardly extending pins and the second pair of outwardly extending pins are frictionally engaged into a mating relationship within the second pair of pin holes (28-B).

The fork (16) when in the attached position is integrally formed and attached with the third pair of outwardly extending protrusions (54). The fork (16) assumes the detached position when the third pair of outwardly extending protrusions (54) are manually manipulated until broken and the third pair of outwardly extending protrusions (54) when manually manipulated until broken form a third pair of outwardly extending pins such as illustrated within FIG. 2. The fork (16) assumes the re-attached position when fork (16) is manually rotated until the third pair of pin holes (28-C) are aligned with the third pair of outwardly extending pins and the third pair of outwardly extending pins are frictionally engaged into a mating relationship within the third pair of pin holes (28-C).

It is to be understood the present invention may be formed into any desirable shape of engineering choice, such as an octagon, rectangular, circular or triangular, etc. with the latter being depicted in FIG. 4 and further defined as follows.

Referring now to FIG. 4 wherein we depict an optional configuration comprising of a combination a food plate (10) having detachable re-attachable eating utensils in the form of a pair of chopsticks. Wherein, food plate (10) is formed from a base member (20) having an upraised exterior edge (22). The base member (20) with upraised exterior edge (22) forming at least a first food compartment (24). Upraised exterior edge having a first pair of outwardly extending protrusions (56) and a second pair of outwardly extending protrusions (58) for attaching a first chopstick (60) and a second chopstick (62). The first pair of outwardly extending protrusions (56) being integrally formed with the first chopstick (60) and the second pair of outwardly extending protrusions (58) being integrally formed with said second chopstick (62). First chopstick (60) having an attached position and a detached position and the second chopstick (62) having an attached position and a detached position. First chopstick (60) when in the attached position is integrally attached and molded with the first pair of outwardly extending protrusions (56) assumes the detached position when the first pair of outwardly extending protrusions (56) are manually manipulated until broken. The second chopstick (62) when in the attached position is integrally attached and molded with the second pair of outwardly extending protrusions (58) assumes the detached position when the second pair of outwardly extending protrusions (58) are manually manipulated until broken.

It can now be seen we have herein provided a new and novel food plate that includes one or multiples of various eating utensils depending on engineering choice and/or end user preferences. The food plate and utensil combination is most cost effective and efficient as it is easily manufactured and produced by a typical plastic mold injection process.

It can further be seen we have provided a new and novel food plate that may include one or more multiple compartments for various food products and/or optional items of choice.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

I claim:

1. In combination a food plate having a detachable re-attachable eating utensil comprising: said food plate being formed from a base member, said base member having an upraised exterior edge, said base member with said upraised exterior edge forming at least a first food compartment, said upraised exterior edge having a first pair of outwardly extending protrusions, said first pair of outwardly extending protrusions being integrally formed with said detachable re-attachable eating utensil, said detachable re-attachable eating utensil having a first pair of pin holes there through that are in alignment with said first pair of outwardly extending protrusions, said detachable re-attachable eating utensil having an attached position a detached position and a re-attached position, said detachable re-attachable eating utensil when in said attached position is integrally attached with said first pair of outwardly extending protrusions, said detachable re-attachable eating utensil assumes said detached position when said first pair of outwardly extending protrusions are manually manipulated until broken, said first pair of outwardly extending protrusions when manually manipulated until broken form a first pair of outwardly extending pins, said detachable re-attachable eating utensil assumes said re-attached position when said detachable re-attachable eating utensil is manually rotated until said first pair of pin holes are aligned with said first pair of outwardly extending pins and said first pair of outwardly extending pins are frictionally engaged into a mating relationship within said first pair of pin holes.

2. The food plate having a detachable re-attachable eating utensil of claim 1 further including said first food compartment being partitioned forming multiple compartments.

3. The food plate having a detachable re-attachable eating utensil of claim 2 wherein one of said multiple compartments is formed into an upraised receptacle.

4. The food plate having a detachable re-attachable eating utensil of claim 3 wherein said upraised receptacle is an integrally formed soup bowl.

5. The food plate having a detachable re-attachable eating utensil of claim 3 wherein said upraised receptacle is of a shape and size to removably receive and support a container therein.

6. The food plate having a detachable re-attachable eating utensil of claim 2 wherein one of said multiple compartments is of a shape and size to removably receive a napkin.

7. The food plate having a detachable re-attachable eating utensil of claim 6 wherein the napkin is pre-packaged and wet.

8. The food plate having a detachable re-attachable eating utensil of claim 1 wherein said upraised exterior edge further includes an additional pair of outwardly extending protrusions that are integrally formed with a toothpick, thus when said additional pair of outwardly extending protrusions are manually manipulated until broken, said toothpick becomes detached for use.

9. The food plate having detachable re-attachable eating utensils of claim 1 is integrally formed by plastic mold injection.

10. The food plate having detachable re-attachable eating utensils of claim 1 is octagonal in shape.

11. In combination a food plate having detachable re-attachable eating utensils comprising: said food plate being formed from a base member, said base member having an upraised exterior edge, said base member with said upraised exterior edge forming at least a first food compartment, said upraised exterior edge having a first pair of outwardly extending protrusions, said upraised exterior edge having a second pair of outwardly extending protrusions, said upraised exterior edge having a third pair of outwardly extending protrusions, said detachable re-attachable eating utensils including a spoon a knife and a fork, said first pair of outwardly extending protrusions being integrally formed with said spoon, said second pair of outwardly extending protrusions being integrally formed with said knife, said third pair of outwardly extending protrusions being integrally formed with said fork, said spoon having a first pair of pin holes there through that are in alignment with said first pair of outwardly extending protrusions, said knife having a second pair of pin holes there through that are in alignment with said second pair of outwardly extending protrusions, said fork having a third pair of pin holes there through that are in alignment with said third pair of outwardly extending protrusions, said spoon having an attached position a detached position and a re-attached position, said knife having an attached position a detached position and a re-attached position, said fork having an attached position a detached position and a re-attached position, said spoon when in said attached position is integrally attached with said first pair of outwardly extending protrusions, said spoon assumes said detached position when said first pair of outwardly extending protrusions are manually manipulated until broken, said first pair of outwardly extending protrusions when manually manipulated until broken form a first pair of outwardly extending pins, said spoon assumes said re-attached position when said spoon is manually rotated until said first pair of pin holes are aligned with said first pair of outwardly extending pins and said first pair of outwardly extending pins are frictionally engaged into a mating relationship within said first pair of pin holes, said knife when in said attached position is integrally attached with said second pair of outwardly extending protrusions, said knife assumes said detached position when said second pair of outwardly extending protrusions are manually manipulated until broken, said second pair of outwardly extending protrusions when manually manipulated until broken form a second pair of outwardly extending pins, said knife assumes said re-attached position when said knife is manually rotated until said second pair of pin holes are aligned with said second pair of outwardly extending pins and said second pair of outwardly extending pins are frictionally engaged into a mating relationship within said second pair of pin holes, said fork when in said attached position is integrally attached with said third pair of outwardly extending protrusions, said fork assumes said detached position when said third pair of outwardly extending protrusions are manually manipulated until broken, said third pair of outwardly extending protrusions when manually manipulated until broken form a third pair of outwardly extending pins, said fork assumes said re-attached position when said fork is manually rotated until said third pair of pin holes are aligned with said third pair of outwardly extending pins and said third pair of outwardly extending pins are frictionally engaged into a mating relationship within said third pair of pin holes.

* * * * *